United States Patent [19]

Brubaker

[11] 4,112,963

[45] Sep. 12, 1978

[54] SIPHON TUBE STARTER

[76] Inventor: John M. Brubaker, Star Rte. Box 48, Hammett, Id. 83627

[21] Appl. No.: 786,375

[22] Filed: Apr. 11, 1977

[51] Int. Cl.[2] ..... F04F 10/00

[52] U.S. Cl. ..... 137/148; 285/9 R; 417/437

[58] Field of Search ..... 137/147, 148, 149, 150, 137/153; 285/8, 9 R; 417/437

[56] References Cited

U.S. PATENT DOCUMENTS

| | | | |
|---|---|---|---|
| 577,438 | 2/1897 | Lloyd | 285/8 X |
| 1,440,706 | 1/1923 | Taylor | 137/148 |
| 1,925,359 | 9/1933 | Alonso | 285/9 R X |
| 2,011,525 | 8/1935 | Parsley | 285/9 R X |
| 3,670,758 | 6/1972 | Willinger | 137/150 |

FOREIGN PATENT DOCUMENTS

| | | | |
|---|---|---|---|
| 871,578 | 4/1942 | France | 137/150 |
| 909,052 | 4/1954 | Fed. Rep. of Germany | 137/148 |
| 306,862 | 4/1933 | Italy | 137/148 |

*Primary Examiner*—Gerald A. Michalsky
*Attorney, Agent, or Firm*—Paul F. Horton

[57] ABSTRACT

A siphon tube starter comprising a cylinder and piston, the base of the cylinder having a tubular inlet extension to which is fastened a soft flexible cone for abutting the end of a siphon tube. Retraction of the piston creates a negative pressure in the cylinder, extension tube and siphon, thereby priming the siphon. The negative pressure causes a temporary, abutting, air tight connection between the flexible cone and the siphon which disappears once the siphon is primed. A guide tube is also provided.

3 Claims, 2 Drawing Figures

FIG. 1
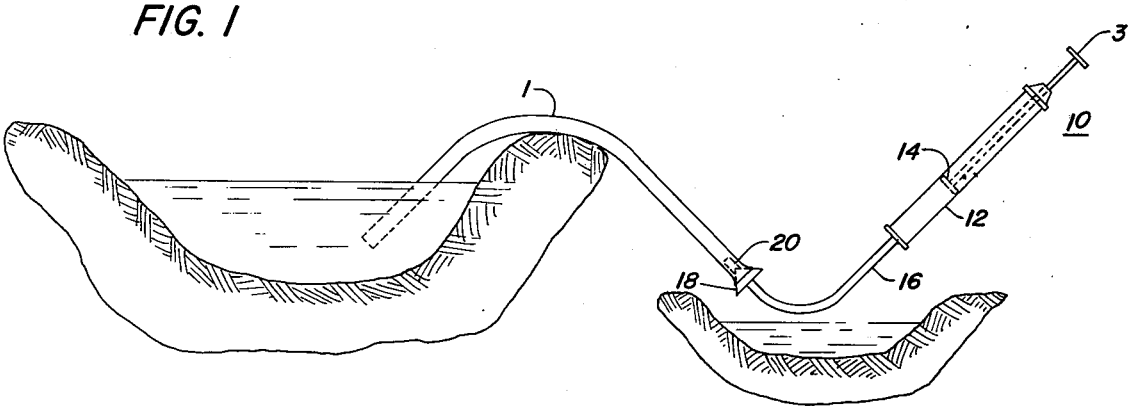
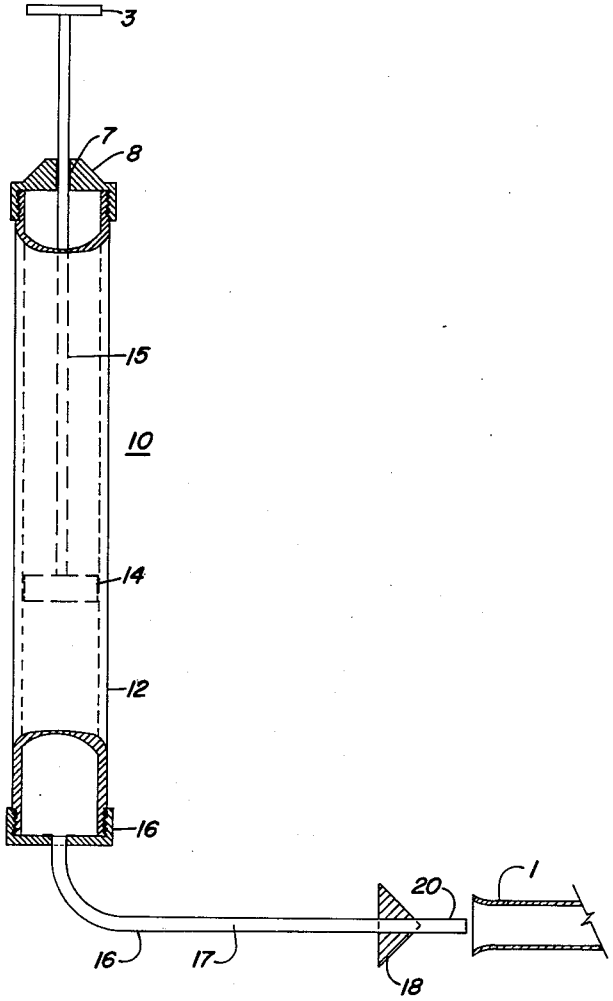
FIG. 2

SIPHON TUBE STARTER

BACKGROUND OF THE INVENTION

1. Field of the Invention

This invention relates, in general, to suction pumps, and, in particular to siphon priming devices.

2. Description of the Prior Art

Conventionally irrigation siphon tubes are primed by placing the hand over one end of the tube and moving the other end of the tube to and fro from shallow to deep water while coordinating these movements with hand movements allowing air to escape from the hand held end of the tube. Not only is a certain amount of aptitude and practice required, but where a number of tubes must be set, the work can be particularly strenuous on the back. To overcome these disadvantages a number of devices have been invented; many utilizing the piston and cylinder. A major disadvantage to existing siphon primers is the necessity of connecting and disconnecting the primer to the siphon tube which is time consuming and exhausting.

SUMMARY OF THE INVENTION

The present invention comprises a cylinder and piston assembly having an inlet extension tube adjacent to and communicating with the base of the cylinder, and a soft flexible cone adapted to fit over the inlet extension tube and to abut the end of a siphon tube. A tube, smaller in diameter than the siphon tube may be attached co-axially to the extension tube for guiding the cone into proper relationship with the siphon tube.

It is therefore an object of the present invention to provide a siphon tube starter having a soft flexible cone temporarily abutting the end of a siphon tube in an air-tight relationship.

Another object of the present invention is to provide a siphon starter having a soft, flexible cone for abutting siphon tubes of varying diameters in an air-tight relationship.

It is also an object of the present invention to provide a siphon tube starter having a flexible cone for temporarily abutting a siphon tube which includes a guide tube for easy and efficent alignment of the cone to the siphon tube.

Additional objects and advantages will become apparent and a more thorough and comprehensive understanding may be had from the following description taken in conjunction with the accompanying drawings forming a part of this specification.

BRIEF DESCRIPTION OF THE DRAWINGS

FIG. 1 is a schematic view of the siphon starter of the present invention showing abutment of the flexible cone to a siphon tube.

FIG. 2 is a view partially in side elevation and section of the siphon starter of the present invention.

DETAILED DESCRIPTION OF THE INVENTION

Referring now to the drawings, a preferred embodiment of a siphon starter made according to the present invention is disclosed. Siphon starter 10 includes cylinder 12, piston 14, handle 3, extension tube 16, cone 18, and guide tube 20.

Mounted for reciprocal motion in a longitudinal direction within cylinder 12 is piston 14 which slidably engages the interior walls of the cylinder in a substantially air-tight engagement. Piston rod 15 extends upwardly from piston 14 through aperture 7 of cap 8 where it terminally engages handle 3 transversly. Threaded on to the other end of cylinder 12 is base 16 to which is attached by welding or otherwise, extension tube 16 having a fluid passage 17 communicating with the interior of the cylinder. Extension tube 16 extends outwardly and preferably radially to the axis of the cylinder and contains adjacent its terminal end a soft, substantially cone shaped bulb, 18, securedly affixed in a concentric relationship. Cone 18 is formed of a soft, pliable, flexible material to adapt to the shape of the siphon outlet. Rubber is the preferred material. It is to be understood that the cone shaped body 18 may be either a bulb or a flange, the important element being a gradually increasing, substantially cone-shaped abutting surface. It is also to be noted the shape of the cone permits the cone to sealingly abut siphon tubes of varying diameters. Siphon starter 10 may contain guide tube 20 which may by either an extension to tube 16 protruding several inches beyond the terminal apex of cone 18 or may be a concentric tube of different diameter, it being important only that guide tube 20 be of less diameter than the siphon tube and that it contain a fluid passage communicating with passage 17 of tube 16.

In operation, the operator grasps cylinder 12 with one hand and handle 3 with the other hand. With piston 14 in a fully inserted position, guide tube 20 is inserted into the end of siphon tube 1 as shown in FIG. 1. In inserting guide tube 20, soft rubber cone 18 is brought into a centered, abutting relationship with the siphon tube and adapts itself to the shape of the end of the siphon. Handle 3 with attached piston 14 is then withdrawn longitudinally creating a partial vacuum within the cylinder, extension tube, guide tube, and the siphon. The vacuum thus created draws rubber cone 18 into substantially air-tight abuttment to the siphon tube. As piston 14 is further withdrawn, water surges through siphon tube 1 producing a siphoning affect. The air pressure within the siphon is thereby lowered and cone 18 is no longer held in firm relationship with the siphon. Device 10 is then removed from contact with the siphon, the piston is pushed in and the siphon starter is in position to start another siphon.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A device for priming a siphon tube comprising:

a cylinder;

an externally operable piston longitudinally movable within said cylinder;

a piston rod connected at one end to said piston, said piston rod upwardly extending through an aperture of a cap securedly affixed to one end of said cylinder;

a handle connected to the other end of said piston rod;

a base portion sealingly engaging the other end of said cylinder;

an inlet tubular extension having one end mounted to said base and extending at substantially a right angle to the axis of said cylinder, said tubular extension having a fluid passageway therein, the passageway communicating with the interior of said cylinder; and a flexible, substantially conical abutment means surrounding and concentric with said tubular extension and mounted to said tubular extension with the apex of said abutment means adjacent the other, free, end of said tubular extension, said conical abutment means operable to sealingly engage one end of the siphon tube during retraction of said piston within said cylinder to create a negative pressure within the siphon tube and operable to release from the siphon tube in the absence of the negative pressure.

2. A device for priming a siphon tube as described in claim 1 wherein said cone-shaped abutment means comprises a rubber bulb.

3. A device for priming a siphon tube as described in claim 1, further comprising a guide tube adapted to loosely engage the interior of the siphon tube, said guide tube connected to the end of said tubular extension and having a fluid passage communicating with the fluid passage of said tubular extension.

* * * * *